United States Patent [19]

Green

[11] 4,376,596

[45] Mar. 15, 1983

[54] PORTABLE ROADWAY

[76] Inventor: M. L. Green, W. Columbia St., Magnolia, Ark. 71753

[21] Appl. No.: 142,177

[22] Filed: Apr. 16, 1980

[51] Int. Cl.[3] ..... E01C 5/16

[52] U.S. Cl. ..... 404/35; 404/40; 283/3; 52/582

[58] Field of Search ..... 404/35, 34, 70, 40, 404/45, 17, 46; 238/3, 14; 52/125, 227, 582, 602

[56] References Cited

U.S. PATENT DOCUMENTS

| | | | |
|---|---|---|---|
| 450,025 | 4/1891 | Jones | 52/582 |
| 1,289,880 | 12/1918 | Newman | 238/3 |
| 1,436,896 | 11/1922 | Newell | 404/40 |
| 1,505,411 | 8/1924 | Newell | 404/35 |
| 1,664,592 | 4/1928 | Cooley | 238/14 |
| 1,960,906 | 5/1934 | Gravell | 52/227 |
| 1,991,931 | 2/1935 | Kling et al. | 404/17 |
| 2,248,537 | 7/1941 | Libbey | 238/14 |
| 2,343,833 | 3/1944 | Pinson | 52/125 |
| 2,351,856 | 6/1944 | Henderson | 52/125 |

FOREIGN PATENT DOCUMENTS

| | | | |
|---|---|---|---|
| 217818 | 12/1956 | Australia | 52/125 |
| 1153048 | 9/1957 | Fed. Rep. of Germany | 404/40 |

*Primary Examiner*—Nile C. Byers, Jr.

*Attorney, Agent, or Firm*—Harvey B. Jacobson

[57] ABSTRACT

A plurality of sections of portable roadway are removably interconnected for use during periods of adverse weather conditions during which soil conditions are such that it is impossible to build a permanent road, or when the economics are such that a temporary road is advantageous. Each section consists of a hardwood frame which is connected to and supports a plywood surface. At the front and rear of each section, a transverse stiffening bar extends through and laterally to the side of the section. Connecting members are attached between the free ends of these stiffening bars. In the center of each section, a lifting bar is disposed to aid in removal and placement of the sections in an expeditious manner.

2 Claims, 6 Drawing Figures

PORTABLE ROADWAY

BACKGROUND OF THE INVENTION

1. Field of the Invention

This invention relates to vehicle supporting surfaces and especially to such surfaces which are adapted to form a temporary road.

2. Discussion of Related Art

Various types of portable roadways and other devices to aid in giving traction to vehicles in soft or muddy road conditions have been suggested in the past. For instance, U.S. Pat. No. 1,289,880, issued Dec. 31, 1918 to Newman, shows a device constructed of a number of transverse blanks forming the top thereof and longitudinal boards forming the bottom thereof. Each device includes one or more handles to facilitate carrying thereof. U.S. Pat. No. 1,664,592, issued Apr. 3, 1928 to Cooley, shows a vehicle support surface which includes parallel longitudinal support members interconnected by a plurality of cross members. Each of the longitudinal members is formed in a trough shape for supporting vehicle wheels. U.S. Pat. No. 2,248,537, issued July 8, 1941 to Libbey, shows an anti-skid device having a plurality of pivotally interconnected sections. Each section has a pair of longitudinal frame members interconnected by transverse traction increasing chains.

SUMMARY OF THE INVENTION

One object of the present invention is to provide a portable roadway formed from sections which can be easily transported to and from a designated area, set up and interconnected for use as a support surface for motor vehicles.

Another object of the present invention is to provide a portable roadway which is relatively simple in construction yet rugged and durable in use. present invention comprises a plurality of individual roadway sections which can be formed in any desired shape or length to allow for the varying topography and the ground conditions existing in the use area. Each section includes a pair of lateral frame members interconnected at their forward and rear ends by transverse frame members. A substantially planar surface composed of plywood is attached to the top of the frame. A forward stiffening bar extends transversely of each section adjacent the forward frame member and a rear stiffening bar extends transversely of each section adjacent the rear frame member. Each stiffening bar has free ends which extend laterally of the section. The free ends of the forward stiffening bar pivotally mount a pair of latch members while the free ends of the rear stiffening bar serve as an engagement point for the latches of adjacent sections. In the center of each section, a lifting bar is disposed which extends across the section and has U-shaped ends extending laterally of the section.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
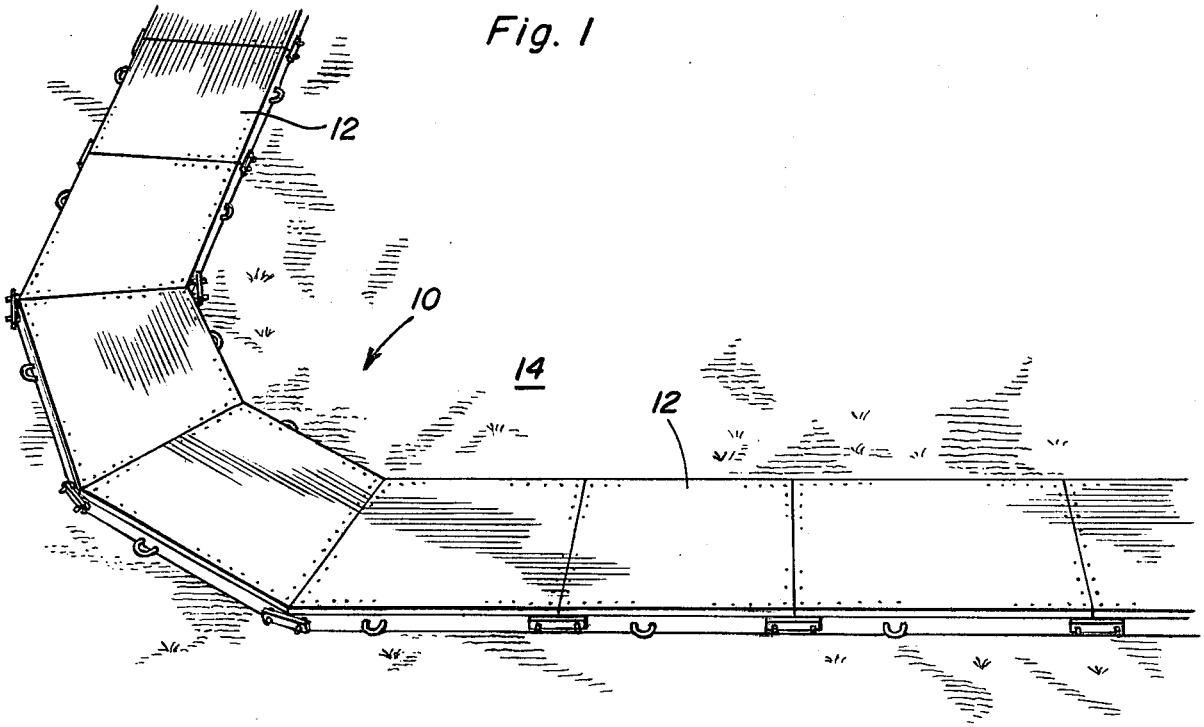
FIG. 1 is a perspective view of a portable roadway formed in accordance with the invention.

Now with reference to the drawings, a portable roadway incorporating the principles and concepts of the present invention and generally referred to by the reference numeral 10 will be described in detail. It can be seen that the roadway 10 is formed from a plurality of individual roadway sections 12 which are formed in shapes and lengths to accommodate the surface 14 upon which the portable roadway is laid. Each section 12 is substantially equal in width with the length and angular orientation of the leading and trailing edge of each section being modified in order to suit the terrain. It will be further understood that adjacent sections 12 have complementary leading and trailing edges in order to form a continuous roadway.

Figure 3:
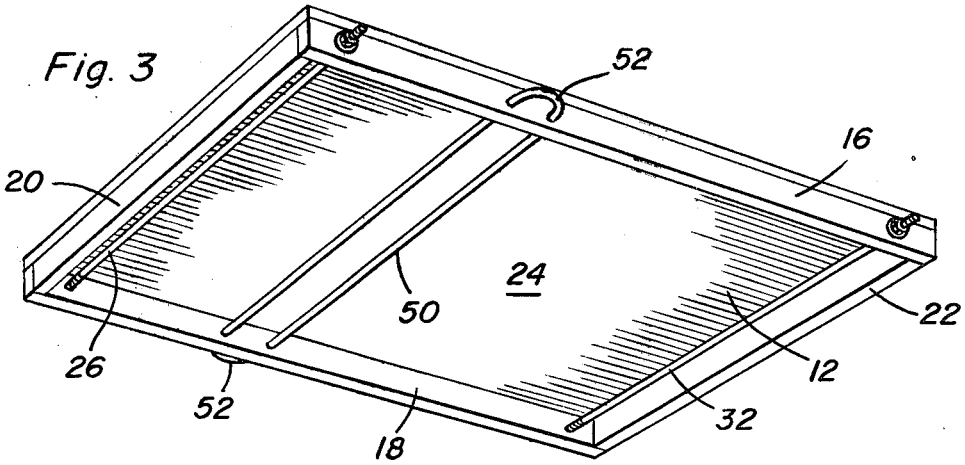
FIG. 3 is a perspective view of one rectangular portable roadway section.
Figure 4:
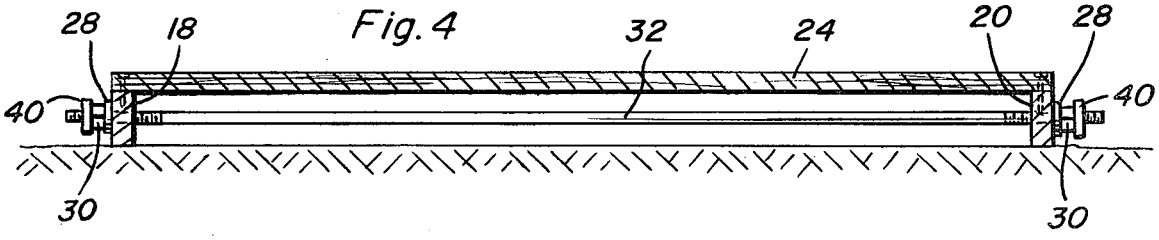
FIG. 4 is a transverse elevational sectional view taken substantially along a plane passing through section line 4—4 of FIG. 2.
Figure 5:
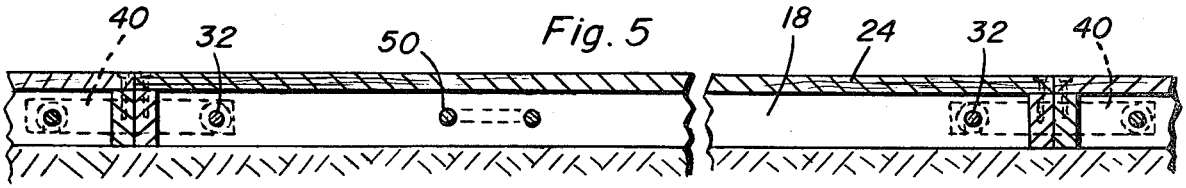
FIG. 5 is a longitudinal elevational sectional view taken substantially along a plane passing through section line 5—5 of FIG. 2.
Figures 2, 6:
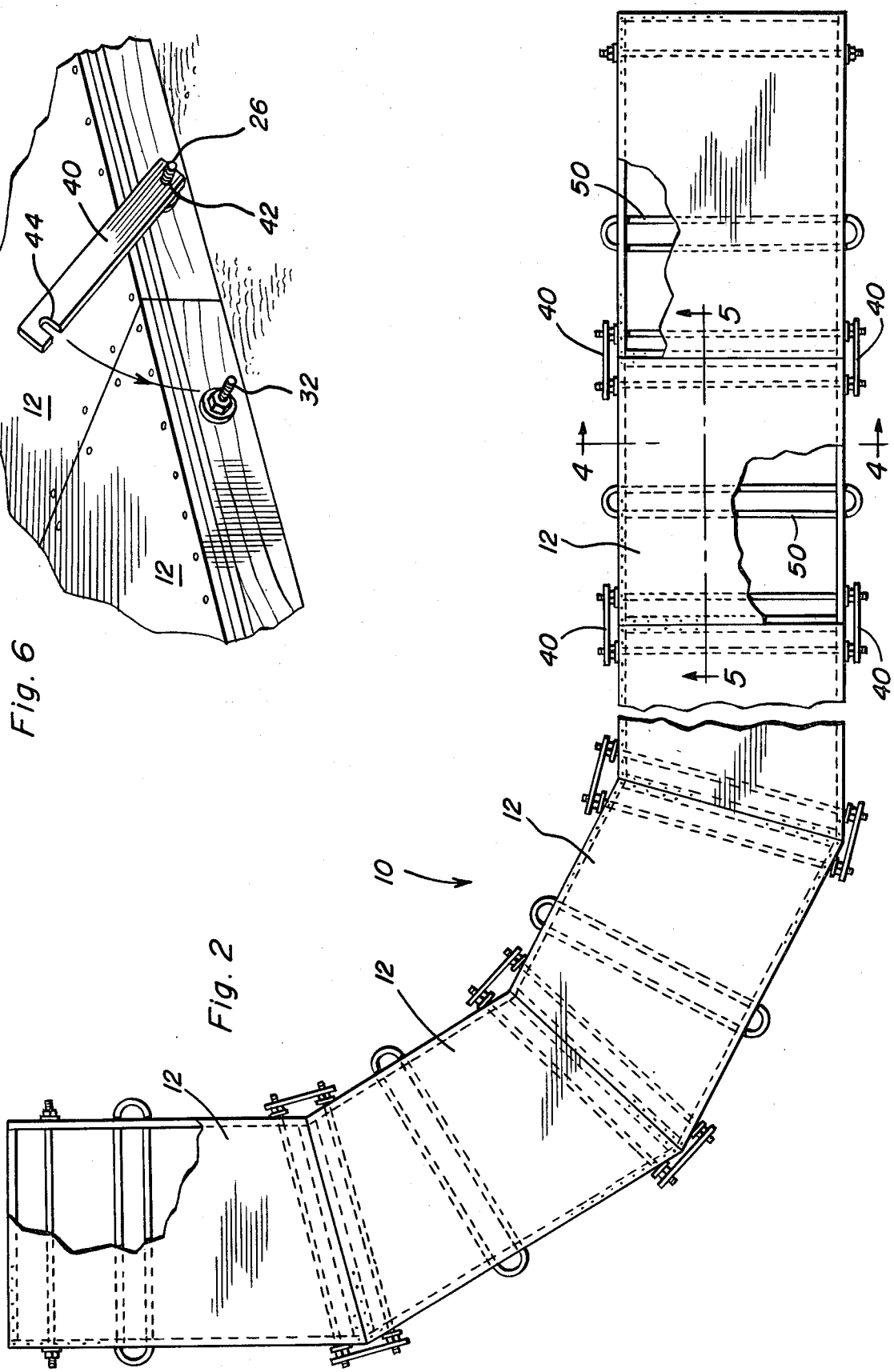
FIG. 2 is a top plan view of the roadway of FIG. 1.
FIG. 6 is a fragmental view showing the interconnection of two adjacent sections.

With specific reference to FIGS. 3–5, a rectangular section 12 will be described in detail. It will be noted that the section 12 comprises a pair of longitudinal frame members 16 and 18 which are substantially parallel and constructed of hardwood lumber. A forward transverse frame member 20 and a rear frame member 22 interconnect the side frame members and are also constructed of hardwood. Any suitable means for connecting the four frame members together such as screws, nails, gluing or the like may be used as desired. A surface 24 comprising a substantially planar sheet of plywood is connected to the top of the four frame members by any suitable means such as through the use of nails, screws or the like. A forward stiffening bar 26 comprising a ¾-inch rod extends transversely of the section 12 through frame members 16 and 18 and has threaded free ends which extend laterally of the frame members. A washer 28 and nut 30 are attached to those free ends and lend support to the frame by forcing the side frame members 16 and 18 together. In like manner, a rear stiffening bar 32 extends transversely through the side frame members and also is held in place through washers 28 and nuts 30. Accordingly, it can be seen that the compressional forces applied to the side frame members aid in holding the frame together and provide rigidity thereto. Each stiffening bar is positioned parallel to the adjacent transverse frame member at a distance of approximately one foot measured perpendicularly between the stiffening bar and transverse frame member. Accordingly, a distance of approximately 2 feet exists between the rear stiffening bar and the forward stiffening bar of adjacent sections 12, as seen in reference to FIG. 6. A connecting link 40, which has a length greater than two feet extends between the forward and rear stiffening rods of adjacent sections 12 and is pivotally attached to the forward stiffening rod through an aperture formed in the link at 42. The link can be slipped on the forward stiffening rod and held in place by the use of a nut or the like, if desired. The opposite end of the connecting link has a notch 44 formed therein which fits over the free end of rear stiffening rod 32. In this manner, it can be seen that the adjacent sections 12 can be placed together in longitudinally aligned fashion with connecting links 40 being used to maintain the sections in alignment.

Each section 12 also includes a lifting bar 50 which extends transversely of the section and has U-shaped ends 52 which extend laterally thereof to facilitate handling of the section. Each lifting bar 50 is formed from a ¾-inch steel rod bent into a continuous loop having U-shaped ends 52 extending to the side. The lifting bar can be connected to the section 12 by any suitable means such as forming two U-shaped members, inserting them into preformed apertures in the respective sides 16 and 18 and welding the free ends together in the center of the section.

Accordingly, it is apparent that a portable roadway has been disclosed which can be used by oil companies, drilling companies, logging operators and the like to erect a traversable surface in inhospitable areas where vehicular movement would otherwise be impaired. Each section 12 should preferably be 10 feet in width and be a maximum of approximately 16 feet in length. The sections are formed with varying angularity in leading and trailing edges in order to allow the roadway to extend around curves, etc.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A portable roadway for facilitating vehicular traffic comprising a plurality of sections, each section including:

a framework having longitudinal, parallel side members and a pair of transverse forward and rear members connected to said side members;

a top panel connected to and overlying said framework in flush peripheral relation;

a forward stiffening bar extending transversely between said side members and disposed adjacent and parallel to said forward frame member;

a rear stiffening bar extending transversely between said side members and disposed parallel and adjacent to said rear frame member, said forward and rear stiffening bars having free ends extending laterally of said framework;

a metal strap pivotally connecting the free ends of the forward and rear stiffening bars of adjacent sections, said laterally extending free ends of the stiffening bars being threaded and having nuts attached thereto disposed against said frame members to apply inward forces to the side frame members, each metal strap including an aperture adjacent one end for pivotal mounting on the free end of one stiffening bar and a downwardly opening notch adjacent the other end for detachable engagement with the free end of a stiffening bar on an adjacent section; and a lifting bar located intermediate said forward and rear stiffening bars and extending transversely between said side members.

2. The invention as defined in claim 1 wherein said lifting bar has recurved ends extending laterally outward of said side members.

* * * * *